US006169256B1

(12) United States Patent
Hanahara et al.

(10) Patent No.: US 6,169,256 B1
(45) Date of Patent: Jan. 2, 2001

(54) PANEL SWITCH AND METHOD OF MOUNTING THE SAME

(75) Inventors: Tetsuro Hanahara, Fukui; Kenji Inoue; Yoshiharu Abe, both of Osaka, all of (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/426,019

(22) Filed: Oct. 25, 1999

(30) Foreign Application Priority Data

Oct. 23, 1998 (JP) ..... 10-302478

(51) Int. Cl.[7] ..... H01H 13/70

(52) U.S. Cl. ..... 200/5 A; 200/341; 200/343; 200/517; 200/296

(58) Field of Search ..... 200/5 R, 5 A, 200/18, 517, 341, 343–345, 293, 295, 296; 400/472, 490, 491, 491.2, 495, 495.1, 496

(56) References Cited

U.S. PATENT DOCUMENTS 4,580,018 * 4/1986 Yoshihara ..... 200/5 A
4,692,571 * 9/1987 Trinh et al. ..... 200/5 A
4,880,950 11/1989 Carson et al. ..... 200/547
4,966,004 10/1990 Midlang et al. ..... 67/77
4,977,298 * 12/1990 Fujiyama ..... 200/5 A
5,349,148 9/1994 Hung ..... 200/562
5,927,483 * 7/1999 Yamada ..... 200/343

* cited by examiner

*Primary Examiner*—Michael Friedhofer
(74) *Attorney, Agent, or Firm*—Ratner & Prestia

(57) ABSTRACT

A panel switch for use in various kinds of electronic appliance comprises (1) a first wiring board having a switch contact formed on an upper surface thereof, a locating hole, and a screw hole, (2) a push button unit made of insulation resin having a frame connecting a movable key button for depressing the switch contact, and disposed on the first wiring board, and (3) a cover for covering the push button unit, having a locating hole and a threaded hole. The push button unit is provided with a locating boss on both of an upper surface and a lower surface of the frame. In assembling the panel switch, the first wiring board and the cover are aligned with respect to each other through the push button unit by inserting the locating bosses on the upper and lower surfaces of the frame into their respective locating holes in the cover and the first wiring board. The panel switch is mounted into an appliance by making a positioning alignment of the panel switch by inserting the locating boss of the frame of the push button unit protruding from the upper surface of the cover into a depression provided in an inner surface of the appliance.

13 Claims, 14 Drawing Sheets

PANEL SWITCH AND METHOD OF MOUNTING THE SAME

FIELD OF THE INVENTION

The present invention relates to a panel switch for use in a variety of electronic appliances such as video equipment, audio equipment, facsimile, copy machine, printer and the like. Further, the invention relates to a method of mounting the panel switch into an appliance.

BACKGROUND OF THE INVENTION

A panel switch of the prior art is described hereinafter by referring to FIG. 9 through FIG. 14.

Incidentally, some of the accompanying figures are cross-sectional views of the panel switch showing only portions where typical structure, spatial arrangement, and the like of individual components are conspicuous.

FIG. 9 is a cross-sectional side view, and FIG. 10 is an exploded perspective view of the panel switch of the prior art. Referring to FIG. 9 and FIG. 10, a first wiring board 1 bears a wiring pattern 1A, and a plural pair of central stationary contacts 1B and peripheral stationary contacts 1C formed on a upper surface thereof. A dome-shaped movable contact 2 made of resilient thin metal sheet is placed on the first wiring board 1 in a manner that an outer periphery of it is in contact with the peripheral stationary contact 1C, and an inner surface of a central vertex portion is opposite to the central stationary contact 1B. The movable contact 2 is adhesively secured to the first wiring board 1 with an insulation film 3, a lower surface of which is coated with adhesive material.

A push button unit 4 made of insulation resin is so constructed that a plurality of movable key-buttons 4C, each provided with a operating key portion 4A on an upside thereof and a protrusion 4B for depressing the movable contact 2 on an underside thereof, are connected to a frame 4D. The push button unit 4 is aligned in position on the first wiring board 1 by inserting a plurality of locating bosses 4E provided on a lower surface of the frame 4D into a plurality of locating holes 1D in the first wiring board 1.

A cover 5 made of metal plate is provided with a plurality of button openings 5A, a display opening 5B, and a plurality of threaded holes 5C. The cover 5 is placed on the push button unit 4 in such a manner that a plurality of the operating key portions 4A of the push button unit 4 protrude from the button openings 5A in the cover 5. The cover 5 covers the push button unit 4, and is secured to the first wiring board 1 with screws 6, which are inserted from a backside of the first wiring board 1 through the screw holes 1E and notches 4F of the push button unit 4, and fastened into the threaded holes 5C. Since the cover 5 is secured to the first wiring board 1 with a plurality of the screws 6, the screw holes 1E of the first wiring board 1 are made to be larger in diameter than a diameter of the screws 6, in order to tolerate variations in finishing dimensions of the plurality of threaded holes 5C and screw holes 1E.

In addition, a second wiring board 8 provided with a liquid crystal display element 7 is disposed on a left side of the first wiring board 1 and the push button unit 4 in such a manner that the liquid crystal display element 7 protrudes from the cover 5 through the display opening 5B having a dimension greater than an outer dimension of the liquid crystal display element 7. The second wiring board 8 is secured to the cover 5 with screws 9 which is inserted from a backside of the second wiring board 8 through a screw hole 8A having a diameter larger than a diameter of the screws 9, and fastened into a threaded hole 5D in the cover 5.

In the panel switch 10 of the above-described structure, the protrusion 4B at the underside of the movable key-button 4C depresses the central vertex portion of the dome-shaped movable contact 2, so as to shift the movable contact 2 downward, when the operating key portion 4A of the push button unit 4 is pushed downward, as shown in FIG. 11. This causes an electrical connection between the central stationary contact 1B and the peripheral stationary contact 1C via the movable contact 2 due to a contact of the inner surface of the central vertex portion of the movable contact 2 with the central stationary contact 1B. When the pushing force to the operating key portion 4A is removed, the inner surface of the central vertex portion of the movable contact 2 moves off the central stationary contact 1B due to a resilient force of restitution of the movable contact 2, and thereby the movable key-button 4C returns to its original position shown in FIG. 9.

FIG. 12 is a cross-sectional view of an electronic appliance equipped with the panel switch 10. In FIG. 12, a console 11 of the electronic appliance is provided with a plurality of button openings 11A and a display window 11B in an upper surface thereof, and a plurality of depressions 11C in a lower surface thereof. The plurality of operating key portions 4A protrude from the button openings 11A, and the liquid crystal display element 7 locates under the display window 11B. The panel switch 10 is placed and mounted in position of the console 11 by inserting protrusions 5E provided on the upper surface of the cover 5 into the depressions 11C in the console 11.

As has been described, the panel switch of the prior art is so constructed that the first wiring board 1 and the cover 5 are fixed together by inserting the screws 6 into the screw holes 1E having a diameter larger than the outer diameter of the screws 6, whereas the push button unit 4 is aligned in position on the first wiring board 1 by inserting the locating bosses 4E into the locating holes 1D. Therefore, the operating key portions 4A of the push button unit 4 deviate out of the centers of the button openings 5A of the cover 5, as shown in FIG. 13, if the screws 6 are fastened into the threaded holes 5C while they are in such positions shifted eccentrically from the screw holes 1E. As a result, the operating key portions 4A touch the button openings 5A if the positioning deviation is excessive, giving rise to a problem that pushing operation is obstructed.

Similar positioning deviation can also occur between the liquid crystal display element 7 disposed on the second wiring board 8 and the display opening 5B of the cover 5, since the screw hole 8A of the second wiring board 8 is larger the than a diameter of the screw 9, and the display opening 5B of the cover 5 is also greater than the outer dimension of the liquid crystal display element 7. If the panel switch 10 assembled as above is installed into an electronic appliance by inserting the projections 5E of the cover 5 into the depression 11C in the console 11, a positioning deviation occurs between the button openings 11A of the console 11 and the operating key portions 4A of the push button unit 4, as well as between the display window 11B and the liquid crystal display element 7, thereby giving rise to another problem that an outward appearance is impaired around the operating key portions and display sections of the appliance.

SUMMARY OF THE INVENTION

A panel switch in accordance with an exemplary embodiment of the present invention includes (1) a first screw; (2)

a first wiring board including (a) a wiring pattern and a switch contact formed on an upper surface of said first wiring board, (b) a first locating hole, and (c) a first screw hole of a diameter larger than a diameter of said first screw; (3) a push button unit made of insulation resin including (a) a movable key-button having an operating key portion and a protrusion on an underside of said operating key portion for depressing said switch contact, (b) a frame for connecting said movable key button, and (c) a plurality of locating bosses provided on an upper surface and a lower surface of said frame, wherein said push button unit being disposed in position on said first wiring board with said locating bosses on the lower surface inserted in said first locating holes of said first wiring board; (4) a cover for covering said push button unit, said cover including (a) a button opening, through said button opening said operating key portion of said push button unit protrudes, (b) a second locating hole wherein said locating boss on the upper surface of said push button unit is inserted, and (c) a first threaded hole; and wherein said first screw is inserted through said first screw hole in said first wiring board, and fastened into said first threaded hole in said cover, for securing said first wiring board and said push button unit to said cover.

Since the panel switch has such structure that positioning alignment of the first wiring board to the cover is made through the push button unit by inserting the locating bosses on the upper and lower surfaces of the push button unit into the locating hole of the cover and the another locating hole of the wiring board, no deviation can occur in position of the operating key portion of the push button unit from the button opening of the cover.

The panel switch in accordance with an exemplary embodiment of the present invention further includes (1) a second screw; and (2) a second wiring board having a third locating hole and a second screw hole in a diameter larger than a diameter of said second screw; and said cover further includes a second threaded hole; wherein said second wiring board is disposed at a side of said first wiring board under said cover, said locating boss provided on the lower surface of said frame of said push button unit is inserted into said third locating hole in said second wiring board, and said second screw inserted in said second screw hole of said second wiring board is fastened into a second threaded hole provided in said cover.

Further, the panel switch in accordance with an exemplary embodiment of the present invention is provided with the push button unit so constructed that at lease one of the plurality of the locating bosses on the upper and lower surfaces of the frame are tapered so that a tip portion is smaller in diameter than a base portion. The tapered tip facilitates insertion of the locating bosses into the locating holes in the cover or the wiring board, thereby reducing assembling time of panel switches as well as cost of them.

Furthermore, the cover used in the panel switch in accordance with an exemplary embodiment of the present invention is further provided with a catch in a shape generally resembling the letter L or the reversed letter T at a lower edge on a side thereof for securing the first wiring board. The first wiring board is aligned in position using the locating boss on the lower surface of the frame of the push button unit, and fixed to the cover together with the push button unit by jamming the first wiring board in the catch. The foregoing structure can reduce a number of components, or the screws used, and ease the assembly of panel switches, so as to reduce the cost even further.

Also, a method in accordance with an exemplary embodiment of the present invention for mounting a panel switch into an appliance comprises the steps of (1) protruding a locating boss on an upper surface of a frame of a push button unit through and above an upper surface of a cover, and (2) aligning a position of the panel switch on the appliance by inserting the locating boss protruding from the upper surface into a depression provided in a lower surface of a console of the appliance. Use of the locating boss of the push button unit for making a positioning alignment of the panel switch with the appliance achieves a proper mounting of the panel switch into the appliance without resulting in a deviation in positions of an operating key portion of the push button unit, a liquid crystal display element, and the like components,

DESCRIPTION OF THE PREFERRED EMBODIMENTS

Figure 1:
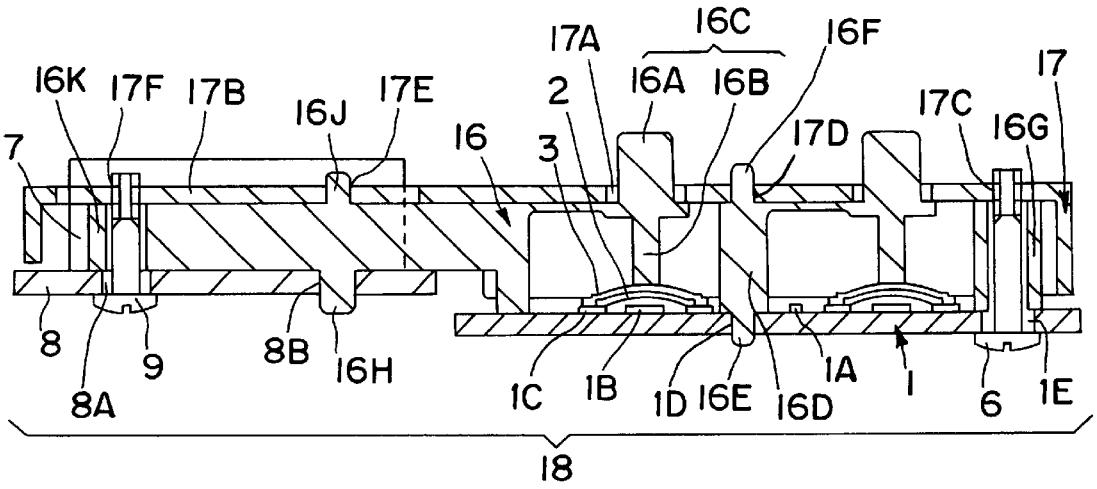
FIG. 1 is a cross-sectional side view depicting a panel switch of a first exemplary embodiment of the present invention.

Preferred exemplary embodiments of the present invention are described hereinafter by referring to FIG. 1 through FIG. 8. Incidentally, each of the accompanying figures shows a cross-sectional view of the panel switch in part where typical structure, spatial arrangement, and the like of individual components are conspicuous. In addition, all components having identical structure to those of the prior art switch are assigned the same reference numerals, and detailed description will be omitted.

First Exemplary Embodiment

Figure 2:
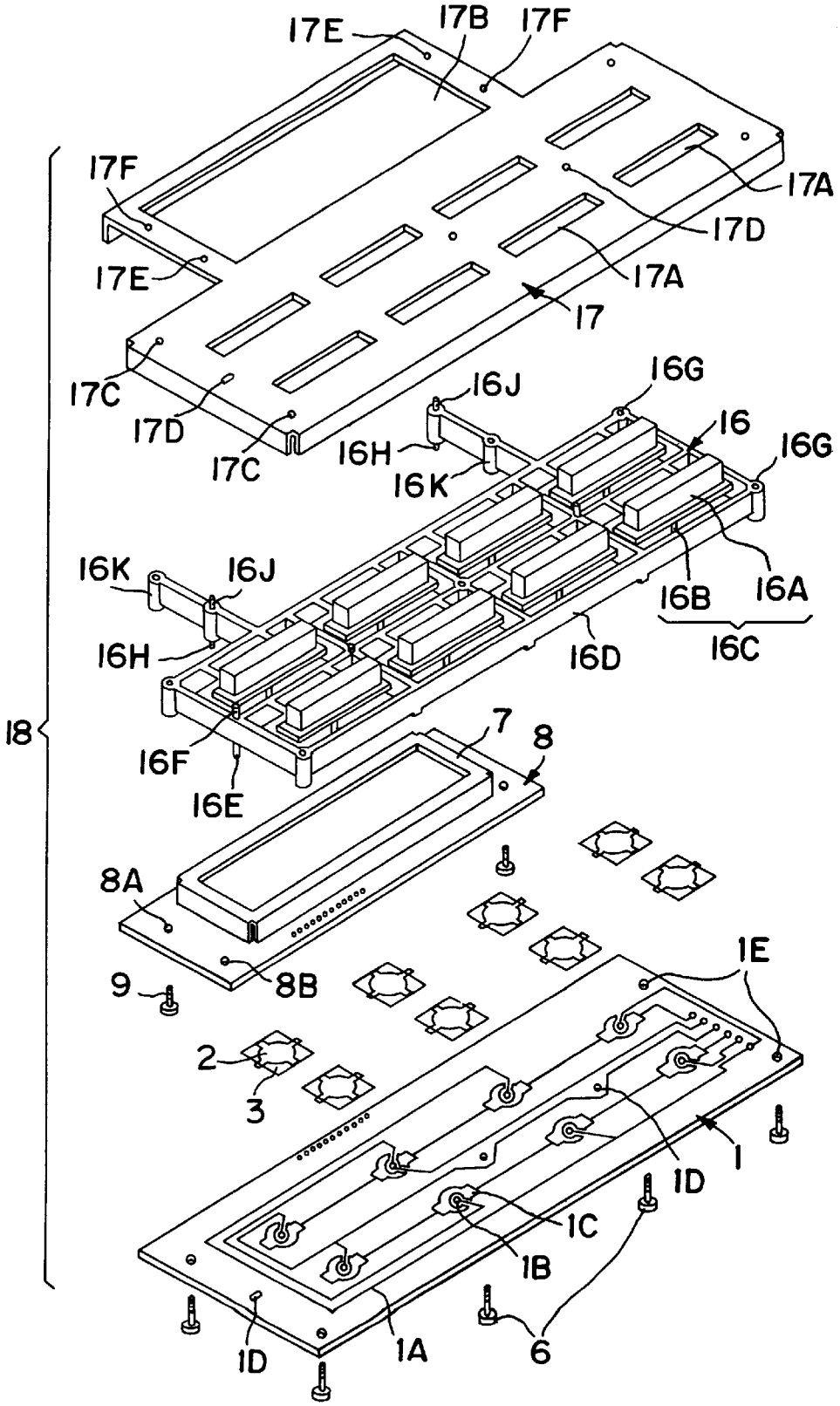
FIG. 2 is an exploded perspective view depicting the same panel switch.

FIG. 1 is a cross-sectional side view depicting a panel switch of a first exemplary embodiment of the present invention, and FIG. 2 is an exploded perspective view of the same panel switch. Referring to FIG. 1 and FIG. 2, a first wiring board 1 bears a wiring pattern 1A, and a plural pair of central stationary contacts 1B and peripheral stationary contacts 1C, all formed on an upper surface thereof. A dome-shaped movable contact 2 made of resilient thin metal sheet is placed on the first wiring board 1 in a manner that an outer periphery is in contact with the peripheral stationary contact 1C, and an inner surface of a central vertex portion is opposite to the central stationary contact 1B. The movable contact 2 is adhesively secured to the first wiring board 1 with an insulation film 3, of which a lower surface is coated with adhesive material. A plurality of movable key-buttons 16C, each of which is provided with a protrusion 16B for depressing the movable contact 2 on an underside surface of an operating key portion 16A, are connected to a frame 16D of a push button unit 16 made of insulation resin. The push button unit 16 is provided with a plurality of locating bosses 16E on its lower surface, and the push button unit 16 is aligned in position on the first wiring board 1 by inserting the locating bosses 16E into a plurality of first locating holes 1D in the first wiring board 1. Although the structure as described above is same as the panel switch of the prior art, the push button unit 16 of the panel switch of this exemplary embodiment is further provided with a locating boss 16F on an upper surface of the frame 16D of the push button unit 16.

A cover 17 made preferably of metal plate is provided with a plurality of button openings 17A, a display opening 17B, and a plurality of first threaded holes 17C. The cover 17 is disposed on and covers the push button unit 16 in such a manner that the plurality of operating key portions 16A of the push button unit 16 protrude from the button openings 17A in the cover 17. The cover 17 for use in the panel switch of this exemplary embodiment is further provided with a second locating hole 17D. A positioning alignment is made between the cover 17 and the push button unit 16 by inserting the locating boss 16F on the upper surface of the frame 16D of the push button unit 16 into the second locating hole 17D. The first wiring board 1 is then secured to the cover 17 with a first screw 6, which is inserted from a reverse side of the first wiring board 1 into a first screw hole 1E having a diameter larger than the first screw 6 and through an inside of a hollow spacer 16G of the push button unit 16, and fastened into the first threaded hole 17C in the cover 17.

In addition, a second wiring board 8 provided with a liquid crystal display element 7 is disposed on a left side of the first wiring board 1 and the push button unit 1 in such a manner that the liquid crystal display element 7 protrudes from the cover 17 through the display opening 17B. The push button unit 16 is provided with a locating boss 16H on the lower surface and another locating boss 16J on the upper surface respectively at a left side of the frame 16D. The locating bosses 16H and 16J on the lower and upper surfaces are inserted in a third locating hole 8B of the second wiring board 8 and a fourth locating hole 17E of the cover 17 respectively.

The second wiring board 8 is fixed to the cover 17 with a second screw 9, which is inserted from a lower side of the second wiring board 8 into a second screw hole 8A having a diameter larger than a diameter of the second screw 9 and through an inside of a hollow spacer 16K of the push button unit 16, and fastened into a second threaded hole 17F in the cover 17.

Figure 3:
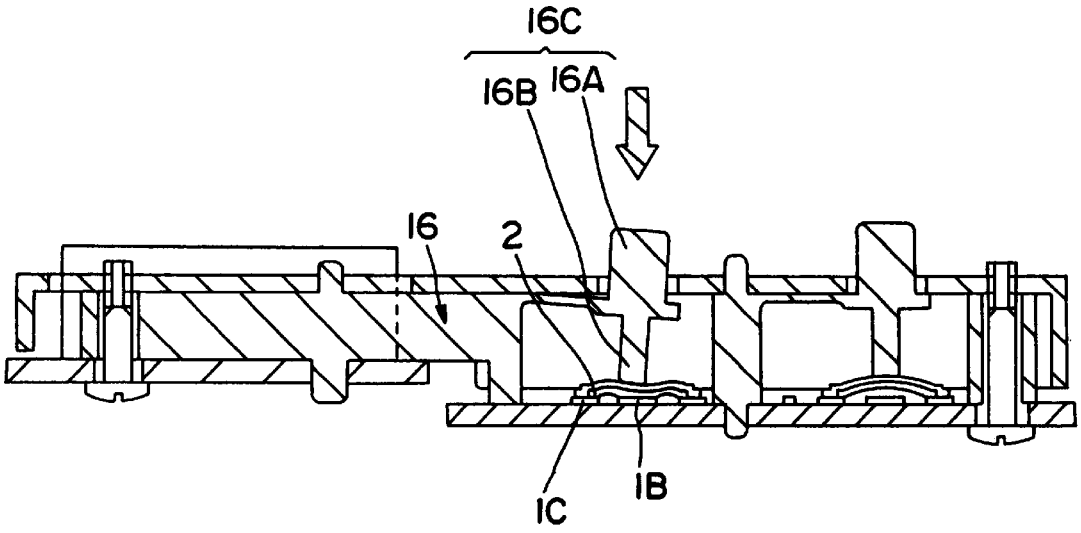
FIG. 3 is a cross-sectional view depicting the same panel switch when a switch key is in a depressed position.

The panel switch 18 of the above-described structure operates in the same manner as the prior art panel switch. That is, when the operating key portion 16A of the push button unit 16 is pushed downward, as shown in FIG. 3, the protrusion 16B at the underside of the movable key-button 16C depresses the central vertex portion of the dome-shaped movable contact 2, so as to shift the movable contact 2 downward. This causes an electrical connection between the central stationary contact 1B and the peripheral stationary contact 1C through the movable contact 2 due to a contact of the lower surface of the central vertex portion with the central stationary contact 1B. When the pushing force to the operating key portion 16A is removed, the lower surface of the central vertex portion of the movable contact 2 moves off the central stationary contact 1B due to a resilient force of restitution of the movable contact 2, and thereby the movable key-button 16C returns to its original position shown in FIG. 1.

Figure 4:
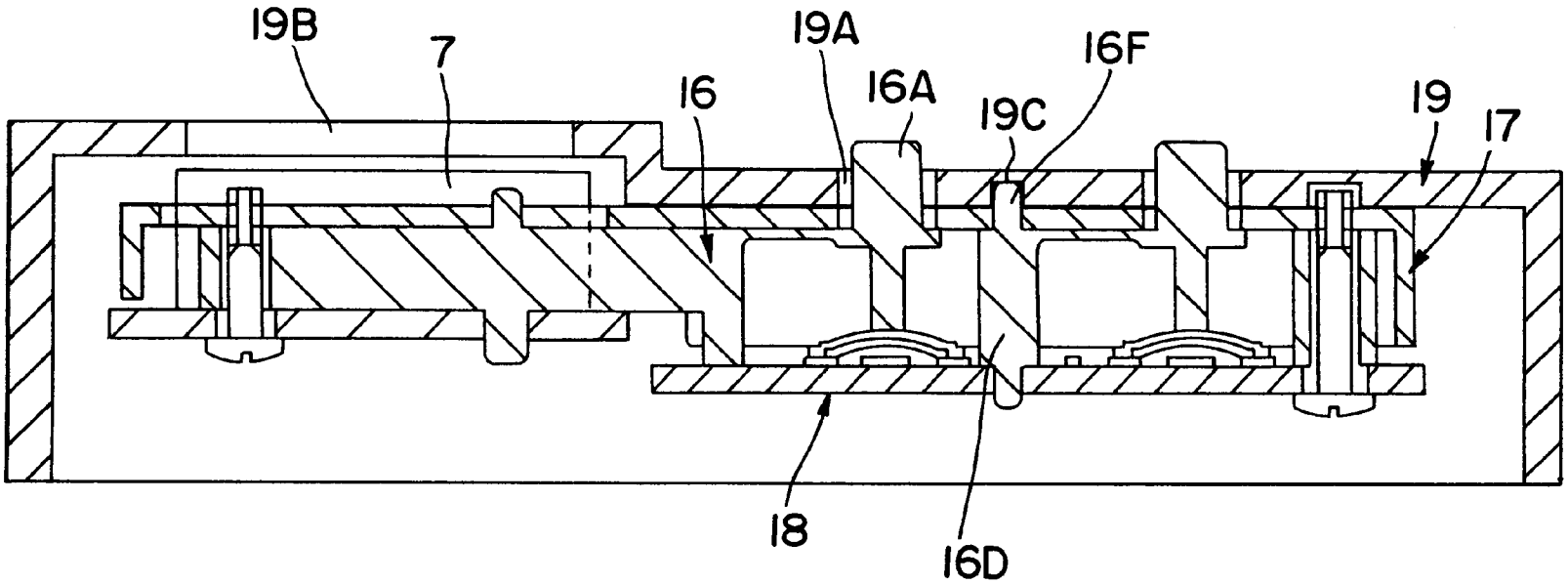
FIG. 4 is a cross-sectional view depicting an electronic appliance equipped with the same panel switch.

FIG. 4 is a cross-sectional view of an electronic appliance equipped with the panel switch 18. In FIG. 4, a console 19 of the electronic appliance is provided with a plurality of button openings 19A and a display window 19B on an upper surface thereof, and a depression 19C in a lower surface thereof. The plurality of operating key portions 16A of the push button unit 16 protrude from the button openings 19A of the console 19, and the liquid crystal display element 7 locates under the display window 19B. The panel switch 18 is aligned and mounted in position of the console 19 by inserting the locating boss 16F on the upper surface of the frame 16D of the push button unit 16 that protrudes from the upper surface of the cover 17 into the depression 19C in the lower surface of the console 11.

In the panel switch 18 of this exemplary embodiment, as has been described, the push button unit 16 is provided with the locating bosses 16F and 16E on both of the upper surface and the lower surface of the frame 16D. The structure of the panel switch is such that positioning alignment of the first wiring board 1 and the cover 17 is made through the push button unit 16 by inserting the locating bosses 16F and 16E on the upper and lower surfaces of the push button unit 16 into the second locating hole 17D in the cover 17 and the other first locating hole 1D in the wiring board 1. This structure provides the panel switch bearing a little positioning deviation in position of the operating key portion 16A of the push button unit 16 from the button opening 17A of the cover 17.

Further, the structure of the panel switch 18 is such that positioning alignment of the cover 17 and the second wiring board 8 provided with the liquid crystal display element 7 is made with the locating bosses 16J and 16H on the upper and lower surfaces of the frame 16D of the push button unit 16, thereby reducing a positioning deviation between the liquid crystal display element 7 and the display opening 17B of the cover 17.

Furthermore, this structure is such that a tip of the locating boss 16F on the upper surface of the frame 16D of the push button unit 16 is protruded through and above the upper surface of the cover 17, and positioning alignment of the panel switch 18 is made with the appliance by inserting the tip of the locating boss 16F into the depression 19C provided in the lower surface of the console 19 of the appliance. This structure allows installation of the panel switch 18 into the electronic appliance without causing a positioning deviation of the operating key portion 16A of the push button unit 16 and the liquid crystal display element 7.

Figure 5:
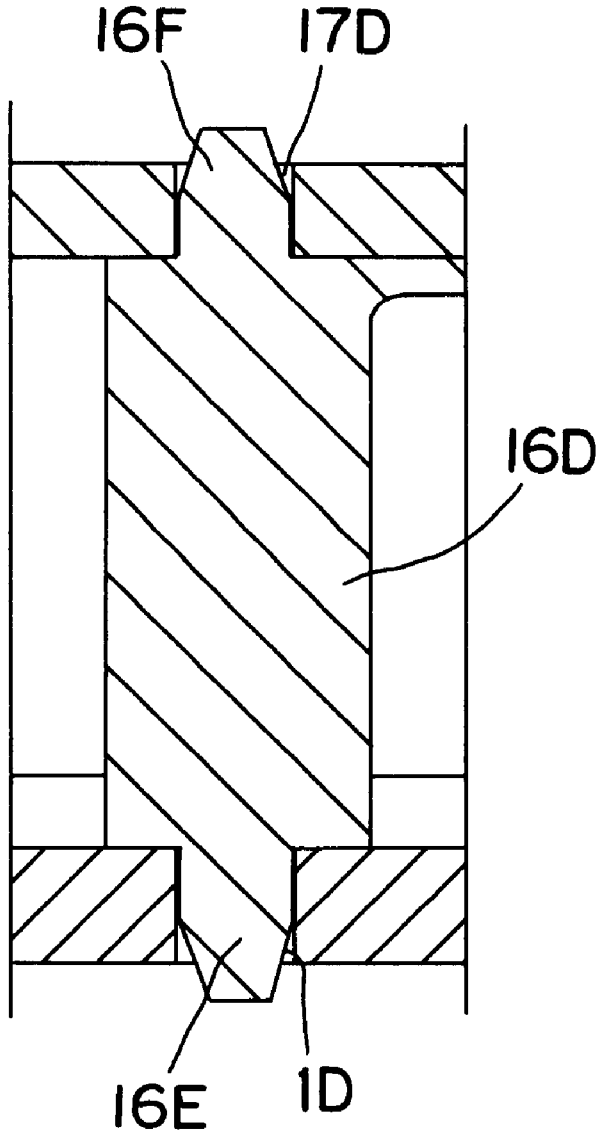
FIG. 5 is a cross-sectional view depicting an essential portion of the same panel switch.

Moreover, this structure is such that at least either of the locating bosses 16F and 16E on the upper and lower surfaces of the frame 16D of the push button unit 16 is tapered so that a tip portion is smaller in diameter than a base portion as shown in FIG. 5. The tapered tip facilitates insertion of the locating boss into the second locating hole 17D of the cover 17 or the first locating hole 1D of the first wiring board 1, thereby reducing assembling time of the panel switch as well as the cost of it.

Second Exemplary Embodiment

Figure 6:
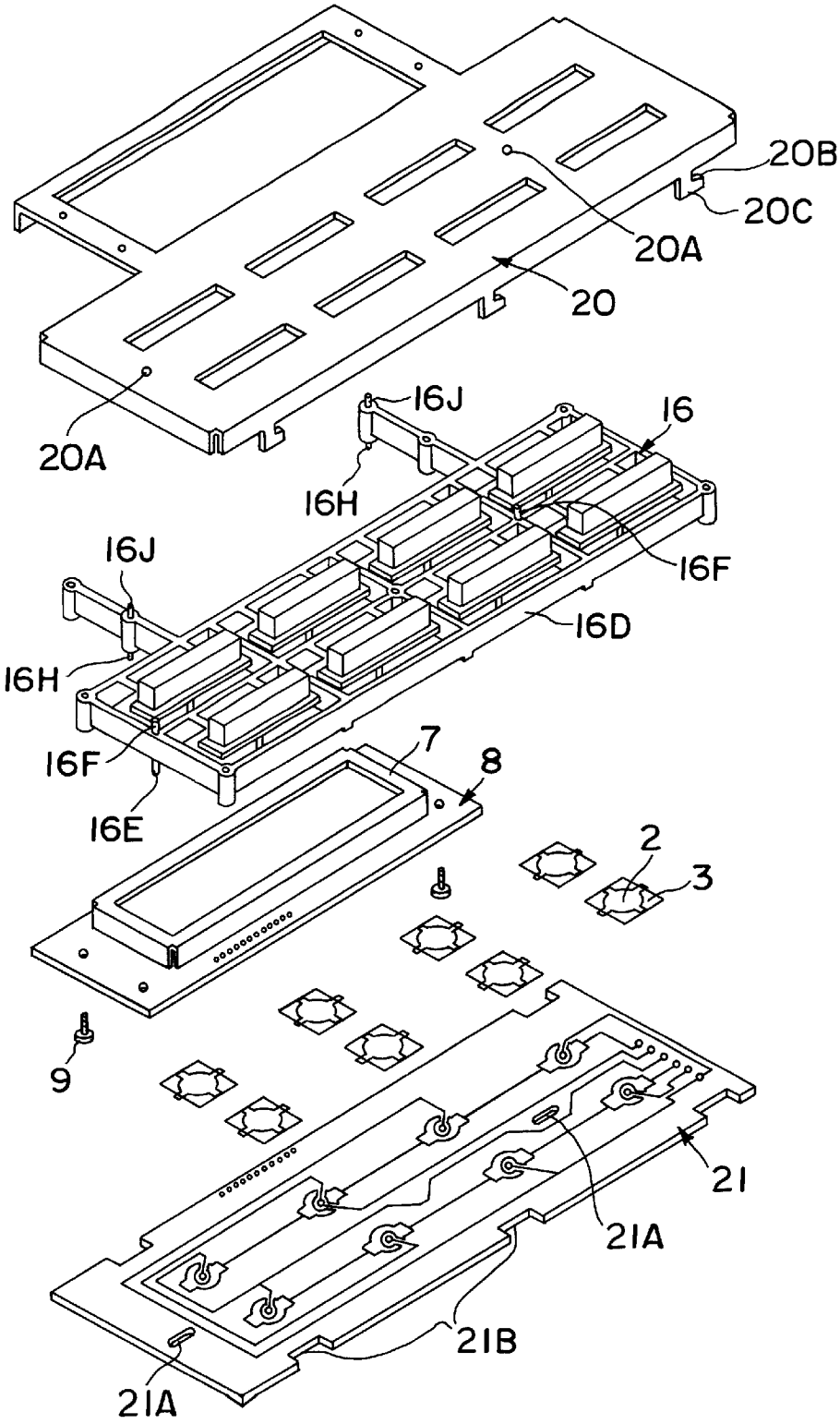
FIG. 6 is an exploded perspective view depicting a panel switch of a second exemplary embodiment of the present invention.

FIG. 6 is an exploded perspective view of a panel switch of a second exemplary embodiment of the present invention. As shown in FIG. 6, a push button unit 16 is provided with locating bosses 16F and 16E on both of an upper surface and a lower surface of a frame 16D. A positioning alignment between a first wiring board 21 and a cover 20 is made through the push button unit 16 by inserting the locating bosses 16F and 16E on the upper and lower surfaces of the frame 16D of the push button unit 16 into a locating hole 20A in the cover 20 and another locating hole 21A in the first wiring board 21. Also, a positioning alignment between a second wiring board 8 provided with a liquid crystal display element 7 and the cover 20 is made with locating bosses 16J and 16H on the upper and lower surfaces of the push button unit 16. The above structure is similar to that of the first exemplary embodiment. However, the cover 20 of the panel switch of this exemplary embodiment is provided, at a lower side edge thereof, with a plurality of catches 20C in a shape generally resembling the letter L extending downwardly and having tapered retaining edges 20B for securing the wiring board.

The first wiring board 21 is provided with a plurality of notches 21B at a side thereof in positions corresponding to the catches 20C of the cover 20. The locating holes 21A are formed into a shape of slit. The first wiring board 21 is secured to the cover 20 by inserting one side of the notches 21B of the first wiring board 21 under their respective tapered retaining edges 20B of the catches 20C of the cover 20, and nipping the first wiring board 21 with the catches 20C.

Figure 7A:
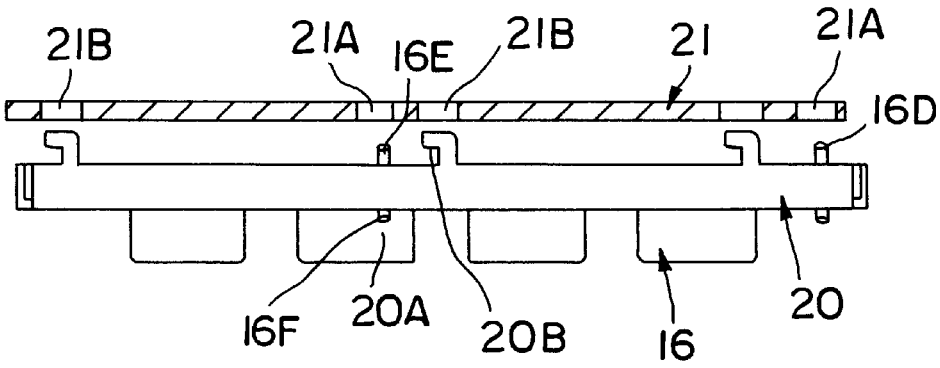
FIGS. 7A to 7C is a cross-sectional view of a part of the same panel switch illustrating a method of assembling.

The panel switch of the above structure is assembled in a manner as described hereinafter. First, the push button unit 16 is disposed on the cover 20, which is placed upside down, as shown in FIG. 7A, while aligning the push button unit 16 in position by inserting the locating boss 16F into the locating hole 20A. The first wiring board 21 is overlaid on the cover 20 by fitting the plurality of notches 21B with the plurality of catches 20C of the cover 20, while maintaining the first wiring board 21 in a position that the surface bearing the movable contact 2 faces downwardly.

Figure 7B:
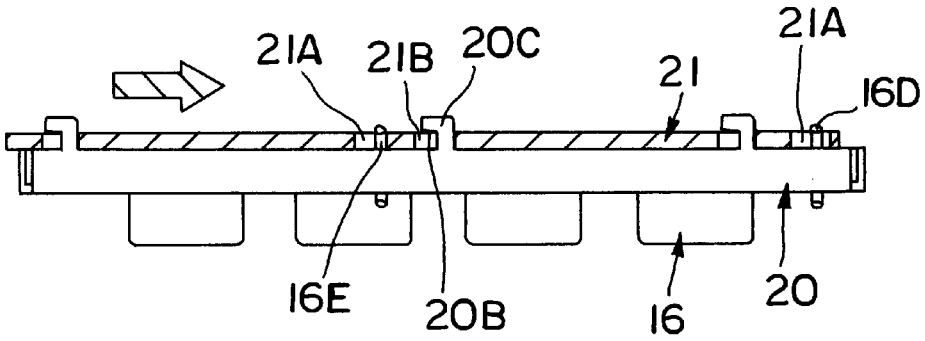
Figure 7C:
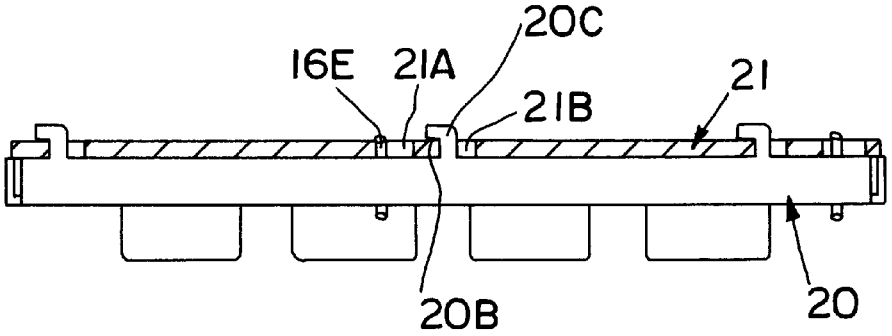

While holding the first wiring board 21 laying on the cover 20, it is slid toward the right side, as shown in FIG. 7B, so as to insert a left side of the notches 21B of the first wiring board 21 under the tapered retaining edges 20B of the generally L-shaped catches 20C of the cover 20. The panel switch is completed, when the tapered retaining edges 20B jams on a back surface (upper surface in FIG. 7C) of the first wiring board 21, and the catches 20C nips the first wiring board 21 to secure it to the cover 20, as shown in FIG. 7C.

The locating boss 16E on the lower surface (upper surface in FIG. 7B) of the frame 16D of the push button unit 16 is free in the locating hole 21A in the first wiring board 21, when it is in the position shown in FIG. 7B, since the locating hole 21A is a slit. When the first wiring board 21 is slid toward the right side, however, the left end of the locating hole 21A strikes the locating boss 16E, as shown in FIG. 7C. Therefore, the alignment is set at this position of the first wiring board 21 on the cover 20 through the push button unit 16.

As described, the panel switch of this exemplary embodiment has the structure, wherein the first wiring board 21 is fixed to the cover 20 by fitting the side of the notches 21B in the generally L-shaped catches 20C, and nipping the first wiring board 21 by the catches 20C. This structure eliminates the need for screws, thereby reducing a number of components. The structure also eases assembly of the switches, and reduces the cost.

Although the panel switch using the catches 20C for nipping the first wiring board 21 is able to maintain a rigidness necessary for the normal usage, the first wiring board 21 and the cover 20 can be secured more reliably by bending some of the catches 20C inward, or tightening them with screws at a few locations.

Also, the catches at the lower side edge of the cover 20 may be formed in a shape generally resembling the letter T, so as to provide a catching hook at both ends. The catches of this shape can hold the wiring board more securely to the cover 20 if a catching hook at one end is bent after the wiring board is slit into and jammed under the other catching hook.

Although the described exemplary embodiment is an example, which adopts the first wiring board 21 provided with the notches 21B, the first wiring board 21 may be provided with slits in stead of notches, so as to fix it to the cover 20 by way of inserting the catches 20C therethrough.

Figure 8:
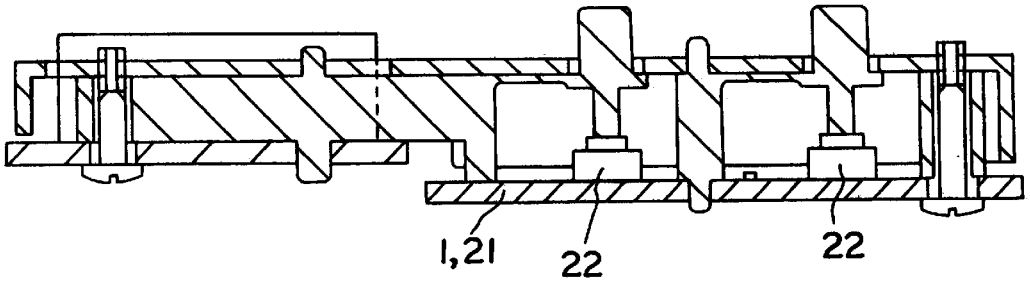
FIG. 8 is a cross-sectional view depicting a panel switch of another exemplary embodiment of the present invention.
Figure 9:
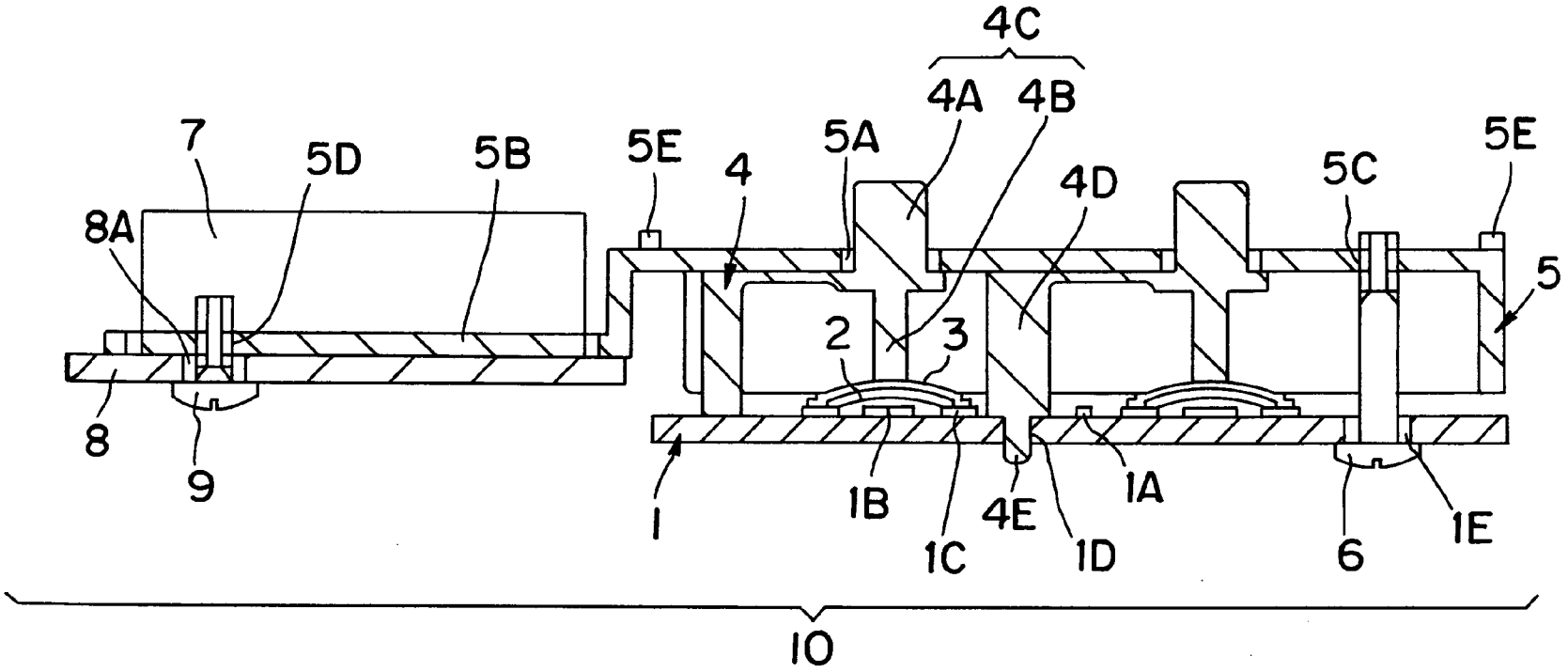
FIG. 9 PRIOR ART
FIG. 9 is a cross-sectional side view depicting a panel switch of the prior art.
Figure 10:
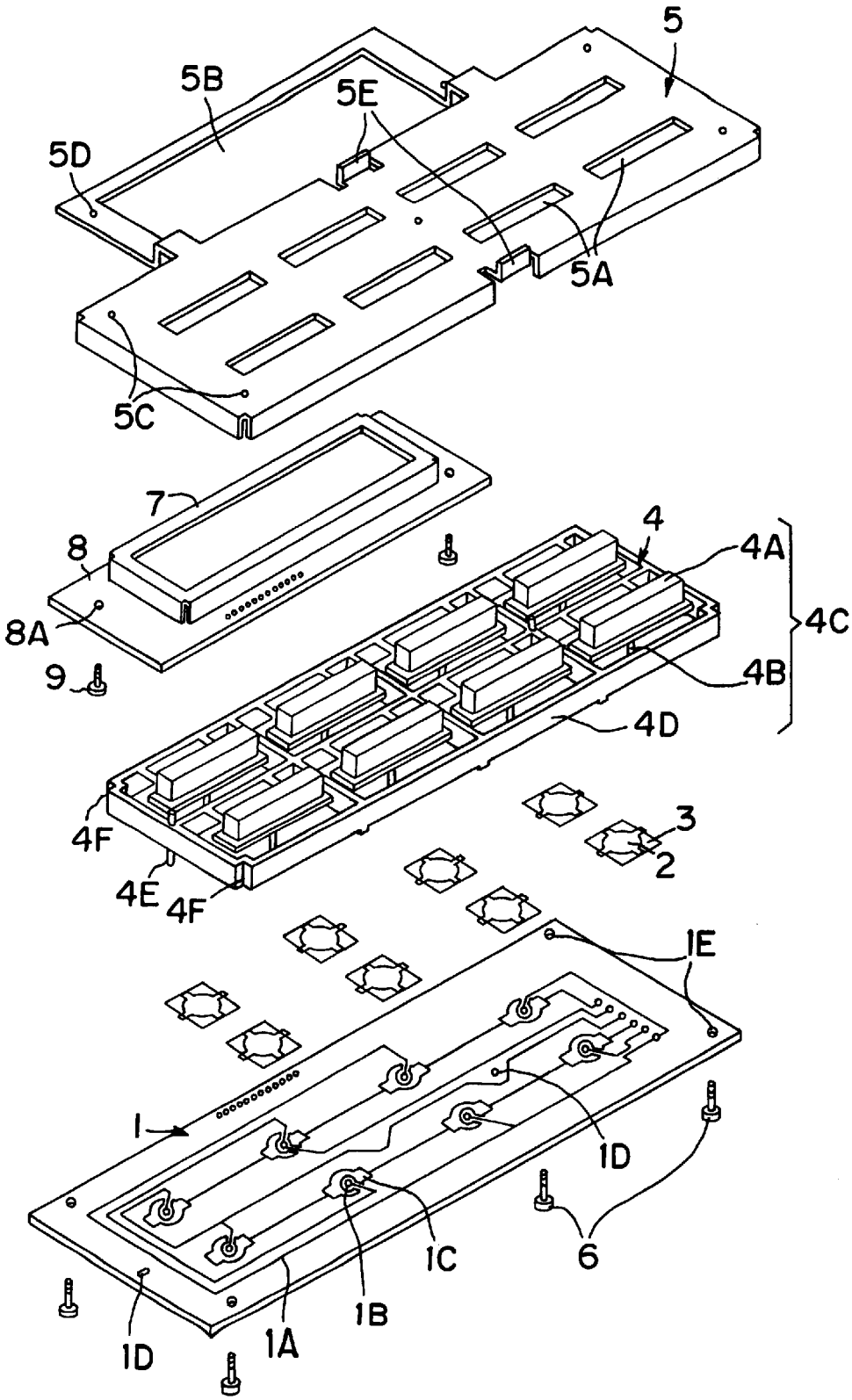
FIG. 10 PRIOR ART
FIG. 10 is an exploded perspective view depicting the same panel switch of the prior art.
Figure 11:
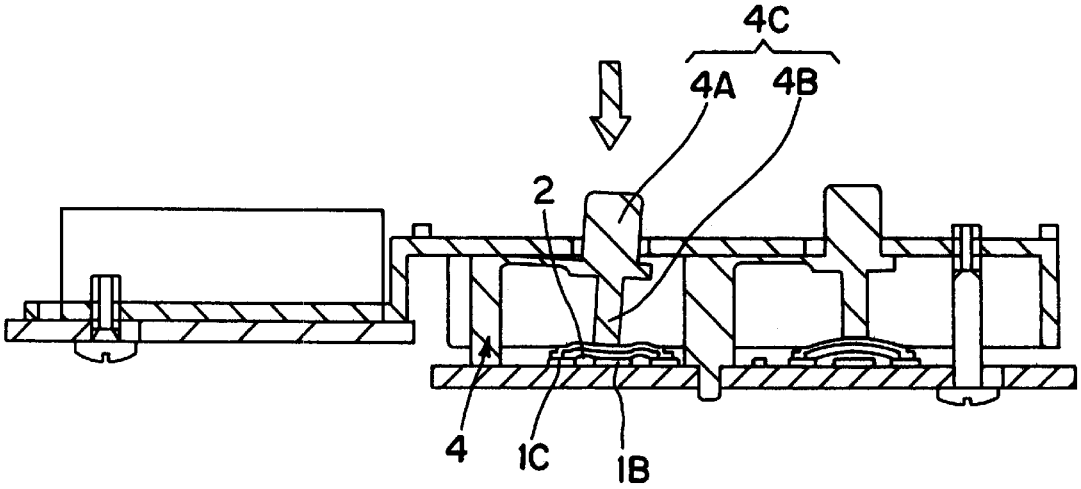
FIG. 11 PRIOR ART
FIG. 11 is a cross-sectional view depicting the same panel switch of the prior art when a switch key is in a depressed position.
Figure 12:
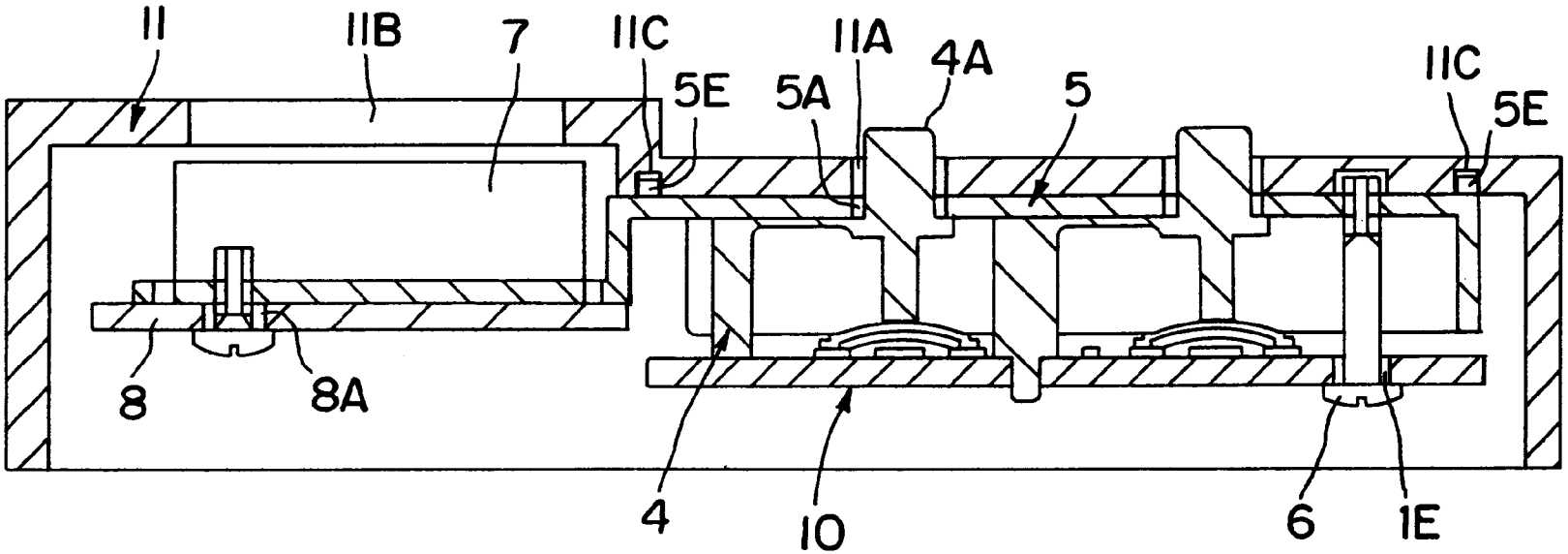
FIG. 12 PRIOR ART
FIG. 12 is a cross-sectional view depicting an electronic appliance equipped with the same panel switch of the prior art.
Figure 13:
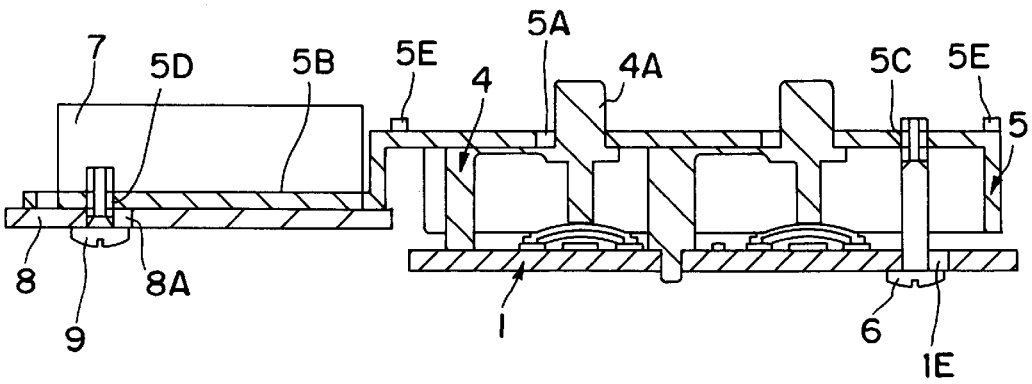
FIG. 13 PRIOR ART
FIG. 13 is a cross-sectional view depicting the same panel switch of the prior art having a positioning deviation.
Figure 14:
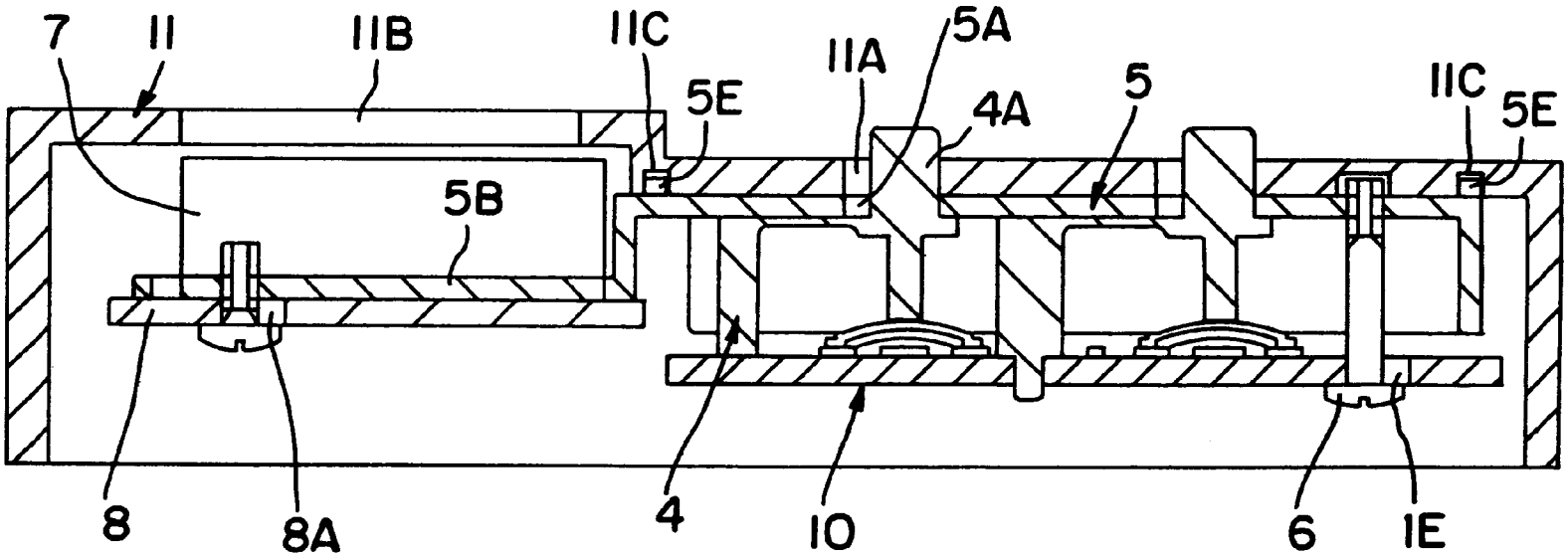
FIG. 14 PRIOR ART
FIG. 14 is a cross-sectional view depicting an electronic appliance equipped with the same panel switch of the prior art having a positioning deviation.

Furthermore, the panel switch of the present exemplary embodiment as described above includes one example of the switch contact structure in that the movable contact 2 made of thin resilient metal sheet is adhesively secured to the first wiring board 1 or 21 with the insulation film 3 coated with adhesive material. However, it may be replaced by any other movable contact such as one, which consists of a dome-shaped member made of a flexible insulation film or elastic rubber, and a contact point placed on an inner surface thereof, and which is disposed on the first wiring board 1 or 21. Or, a self-contained unitary push switch 22 may be mounted on the first wiring board 1 or 21, as shown in FIG. 8, in place of the pair of stationary contacts and the movable contact. Accordingly, the present invention can be embodied with any other kind of switch contacts besides the above.

As has been discussed, the present invention provides an advantage of realizing a panel switch that eliminates a positioning deviation between the operating key portion of the push button unit and the button opening of the cover, as well as a method of mounting the panel switch into an appliance.

What is claimed is:

1. A panel switch comprising:

(1) a first screw;

(2) a first wiring board including (a) a switch contact coupled to an upper surface of said first wiring board, (b) a first locating hole, and (c) a first screw hole of a diameter larger than a diameter of said first screw;

(3) a push button unit made of insulation resin including (a) a movable key-button having an operating key portion and a protrusion on an underside of said operating key portion for depressing said switch contact, (b) a frame for connecting said movable key button, and (c) a first set of locating bosses provided on an upper surface and a second set of locating bosses provided on a lower surface of said frame, wherein said push button unit being disposed in position on said first wiring board with said second set of locating bosses on the lower surface inserted in said first locating holes of said first wiring board;

(4) a cover for covering said push button unit, said cover including (a) a button opening, through said button opening said operating key portion of said push button unit protrudes, (b) a second locating hole wherein said first set of locating bosses on the upper surface of said push button unit is inserted, and (c) a first threaded hole; and wherein said first screw is inserted through said first screw hole in said first wiring board, and fastened into said first threaded hole in said cover, for securing said first wiring board and said push button unit to said cover.

2. The panel switch according to claim 1 wherein said cover is made of metal.

3. The panel switch according to claim 2, wherein at least one of said plurality of locating bosses on the upper and lower surfaces of said frame of said push button unit are tapered so that a tip portion thereof is smaller in diameter than a base portion thereof.

4. The panel switch according to claim 3, wherein said cover is further provided with a catch in a shape substantially resembling a letter L or a reversed letter T at a lower edge on a side thereof for securing said first wiring board, and said first wiring board and said push button unit are secured to said cover by aligning said first wiring board in position using said second set of locating bosses on the lower surface of said frame of said push button unit, and by jamming said first wiring board in said catch.

5. The panel switch according to claim 2, wherein said cover is further provided with a catch in a shape substantially resembling a letter L or a reversed letter T at a lower edge on a side thereof for securing said first wiring board, and said first wiring board and said push button unit are secured to said cover by aligning said first wiring board in position using said second set of locating bosses on the lower surface of said frame of said push button unit, and by jamming said first wiring board in said catch.

6. The panel switch according to claim 1 further comprising:

(1) a second screw; and (2) a second wiring board having a third locating hole and a second screw hole in a diameter larger than a diameter of said second screw; and said cover further includes a second threaded hole;

wherein said second wiring board is disposed at a side of said first wiring board under said cover, one of said second set of locating bosses provided on the lower surface of said frame of said push button unit is inserted into said third locating hole in said second wiring board, and said second screw inserted in said second screw hole of said second wiring board is fastened into a second threaded hole provided in said cover.

7. The panel switch according to claim 6, wherein at least one of said plurality of locating bosses on the upper and lower surfaces of said frame of said push button unit are tapered so that a tip portion thereof is smaller in diameter than a base portion thereof.

8. The panel switch according to claim 7, wherein said cover is further provided with a catch in a shape substantially resembling a letter L or a reversed letter T at a lower edge on a side thereof for securing said first wiring board, and said first wiring board and said push button unit are secured to said cover by aligning said first wiring board in position using said second set of locating bosses on the lower surface of said frame of said push button unit, and by jamming said first wiring board in said catch.

9. The panel switch according to claim 6, wherein said cover is further provided with a catch in a shape substantially resembling a letter L or a reversed letter T at a lower edge on a side thereof for securing said first wiring board, and said first wiring board and said push button unit are secured to said cover by aligning said first wiring board in position using said second set of locating bosses on the lower surface of said frame of said push button unit, and by jamming said first wiring board in said catch.

10. The panel switch according to claim 1, wherein at least one of said plurality of locating bosses on the upper and lower surfaces of said frame of said push button unit are tapered so that a tip portion thereof is smaller in diameter than a base portion thereof.

11. The panel switch according to claim 10, wherein said cover is further provided with a catch in a shape substantially resembling a letter L or a reversed letter T at a lower edge on a side thereof for securing said first wiring board, and said first wiring board and said push button unit are secured to said cover by aligning said first wiring board in position using said second set of locating bosses on the lower surface of said frame of said push button unit, and by jamming said first wiring board in said catch.

12. The panel switch according to claim 1, wherein said cover is further provided with a catch in a shape substantially resembling a letter L or a reversed letter T at a lower edge on a side thereof for securing said first wiring board, and said first wiring board and said push button unit are secured to said cover by aligning said first wiring board in position using said second set of locating bosses on the lower surface of said frame of said push button unit, and by jamming said first wiring board in said catch.

13. A method of mounting a panel switch into an appliance, said method comprising the steps of:

providing a first screw providing a first wiring board including (a) a switch contact coupled to an upper surface of a first wiring board, (b) a first locating hole, and (c) a first screw hole of a diameter larger than a diameter of said first screw;

providing a push button unit made of insulation resin including (a) a movable key-button having an operating key portion and a protrusion on an underside of said operating key portion for depressing said switch contact, (b) a frame for connecting said movable key button, and (c) a plurality of locating bosses provided on an upper surface and a lower surface of said frame, wherein said push button unit being disposed in position on said first wiring board with said locating bosses on the lower surface inserted in said first locating holes of said first wiring board;

providing a cover for covering said push button unit, said cover including (a) a button opening, through said button opening said operating key portion of said push button unit protrudes, (b) a second locating hole wherein said locating boss on the upper surface of said push button unit is inserted, and (c) a first threaded hole; and inserting said first screw through said first screw hole in said first wiring board, fastening said first screw into said first threaded hole in said cover, to secure said first wiring board and said push button unit to said cover in order to form said panel switch;

protruding said locating boss on said upper surface of said frame; and aligning said panel switch in position on said appliance by inserting said locating boss protruding from the upper surface into a depression provided in a lower surface of said appliance.

* * * * *